US007412733B2

(12) United States Patent
Dorsch

(10) Patent No.: US 7,412,733 B2
(45) Date of Patent: Aug. 19, 2008

(54) RETRACTABLE COVER ARRANGEMENT FOR HOT TUBS AND THE LIKE

(75) Inventor: Chris Dorsch, Silver Spring, MD (US)

(73) Assignee: Dorsch, Inc., Silver Spring, MD (US)

( * ) Notice: Subject to any disclaimer, the term of this patent is extended or adjusted under 35 U.S.C. 154(b) by 512 days.

(21) Appl. No.: 11/073,740

(22) Filed: Mar. 8, 2005

(65) Prior Publication Data

US 2006/0200900 A1 Sep. 14, 2006

(51) Int. Cl.
*E04H 4/00* (2006.01)

(52) U.S. Cl. ..... 4/498; 4/500

(58) Field of Classification Search ..... 49/33, 49/128–130, 209, 227; 4/498, 500
See application file for complete search history.

(56) References Cited

U.S. PATENT DOCUMENTS 2,817,274 A * 12/1957 Benoit ..... 49/209
4,271,542 A 6/1981 Wood et al.
5,303,527 A 4/1994 Perez et al.
5,346,355 A * 9/1994 Riemer ..... 414/542
6,374,433 B1 * 4/2002 Gray ..... 4/498
6,718,566 B1 4/2004 Wilson
2004/0055081 A1 3/2004 Wilson

FOREIGN PATENT DOCUMENTS

JP 2008464 1/1990
JP 07166727 6/1995
JP 09296553 11/1997

* cited by examiner

*Primary Examiner*—Khoa D Huynh
(74) *Attorney, Agent, or Firm*—Ross Hunt; Chris Dorsch

(57) ABSTRACT

A system is provided for automatically providing covering and uncovering of a recessed area including a hot tub or the like. The system includes a cover assembly including a stationary section, and a movable cover section movable with respect to the stationary section between (i) a retracted, stowed position, out of the plane of the stationary section and in vertical registration with the stationary section, wherein the hot tub is uncovered, and (ii) an operative, extended position, in the plane of the stationary section and in end-to-end registration with the stationary section, wherein the hot tub is covered.

7 Claims, 4 Drawing Sheets

RETRACTABLE COVER ARRANGEMENT FOR HOT TUBS AND THE LIKE

FIELD OF THE INVENTION

The present invention relates to retractable cover assemblies for covering and uncovering a hot tub and the like.

BACKGROUND OF THE INVENTION

Hot tubs and other spa and/or bathing units employing a tub or the like, herein referred to collectively as hot tubs, are usually equipped with a cover or the like when located outdoors, e.g., on a deck or in another environment wherein the cover is used to protect the hot tub and/or to prevent others from inadvertently falling into the hot tub or otherwise being injured by the uncovered tub. Such covers are typically designed to be manually manipulated into place by the user and manually removed, and this manipulation of the cover can be awkward and cumbersome. Moreover, providing suitable storage of the cover can also present a problem.

Automatic or semi-automatic systems have also been developed for providing covering and uncovering movements of covers, flooring and the like, for spas and swimming pools. Some examples of patented systems and devices of this type are discussed below.

U.S. Pat. No. 6,718,566, and Published Application No. 20040055081, both to Wilson, disclose a vertically adjustable spa cover assembly including a cover movable above a spa between a raised position and a lowered position, the raised position being vertically above the lowered position. Lifts are used to raise and lower the cover. The cover assembly may also include a screen that surrounds the area between the cover and the spa. The lifts are threaded sections including rods and pipes which engage one another and move up and down as one or more of these threaded sections are rotated by a power source such as a motor or hand crank. The power source may engage the threaded sections through gears or sprockets, or less directly via a system of sprockets and a chain which drives the sprockets and the threaded sections in turn. Alternatively, the lifts may be telescoping members pneumatically or hydraulically powered. The cover assembly may be built into a spa unit or added as a retrofit component.

U.S. Pat. No. 4,271,542 to Wood et al. discloses a vertically adjustable pool platform, for use in a swimming pool, a means to vertically raise and lower the platform, and a means connecting the platform to the means to vertically raise and lower the platform. The pool platform is buoyant so as to normally float on the surface of the water, and is constantly urged to float to the surface of the water, when submerged under water at a predetermined level. The platform permits vertical passage of water therethrough.

U.S. Pat. No. 5,303,527 to Perez et al. discloses a removable support apparatus for supporting a swimming pool cover employing adjustable frame assemblies capable of spanning between opposite edges at opposite sides of the pool. Each frame assembly includes a pair of separate frame members placed in side-by-side relation to one another so that, together, they define the overall length of the frame assembly. The frame members are displaceable longitudinally relative to one another to adjust the overall length of the frame assembly so as to match the distance between the opposite edges of the pool so that the frame assembly can fit across the pool between its opposite edges Each frame assembly also includes an end support member attached to the outer end of each frame member and supporting the frame member from one of the opposite edges of the pool. The frame assembly further includes adjustable attaching members releasably attaching the frame members to one another in the longitudinally-displaced side-by-side relation such that the frame assembly will span between the opposite sides of the pool. The removable support apparatus also includes at least one adjustable column support member removably installed in upright standing relation on the bottom of the pool and releasably supporting a selected frame assembly, and a framework overlying and supported by the frame assemblies so as to span across the length and width of the swimming pool for, in turn, supporting a pool cover.

JP07166727A2 discloses a normally/reversely rotatable motor installed in a control room, and a rotary shaft. One end of the shaft is supported by a first bearing and the other end is supported by a sealed bearing equipped in a bulkhead part between the control room and a pool. The motor and the rotary shaft are connected to each other, and circumferential surfaces of drums coaxially mounted on the rotary shaft are connected by means of wire ropes to the underneath of a floor board so as to provide buoyancy.

JP02008464 discloses a vertically movable floor support for a swimming pool which includes a vertically movable floor, screw jacks set below the floor, and a drive source for expanding or contracting the jacks. The jacks are set at a given interval in the space between the floor and a foundation slab formed below the pool bottom. When a switch for indicating extension or contraction is activated, bevel gears are turned synchronously by drive motors, and a piston rod is raised to adjust the floor to a given height. The motors are stopped by action of sensor.

SUMMARY OF THE INVENTION

In accordance with the invention, a retractable cover or floor arrangement is provided for covering hot tubs, spas and the like. In preferred embodiments, the cover arrangement enables a cover or floor section to be automatically retracted and stowed out of sight. Further, in the operative position thereof, wherein the cover or floor section provides a protective cover for the hot tub or the like, the cover is a flush fit with a stationary portion of the hot tub environment, his stationary portion preferably being in the form of a stationary floor section. The overall arrangement is both highly effective from a functional standpoint, as well as aesthetically pleasing in appearance. Further, in an important embodiment, the movable and stationary floor sections combine to form a usable floor above the hot tub which can be walked on and used as a dance floor.

In accordance with one aspect of the invention, there is provided a system for automatically providing covering and uncovering of a recessed area, the system comprising:

a cover assembly comprising a movable cover section movable with respect to a stationary member disposed adjacent to the recessed area and defining a plane; and means for moving the movable section between (i) a retracted, stowed position, out of the plane of the stationary member and in vertical registration with the stationary member, wherein the recessed area is uncovered, and (ii) an operative, extended position, in the plane of the stationary member and in end-to-end registration with the stationary member, wherein the recessed area is covered.

Preferably, the system further comprises a further recessed area disposed adjacent to the first-mentioned recessed area and defining a support surface, the stationary member comprises a stationary section of said cover assembly and is disposed so as to cover the further recessed area, and the movable section is supported on the support surface of the further recessed area, beneath said stationary section, in the stowed position of the movable section.

As indicated above, the stationary member preferably comprises a stationary section of the cover assembly, and, in an important implementation, the moving means comprises mechanical means for providing longitudinal movement of the movable section between said stowed position and an intermediate end position out of vertical registration with the stationary section and for providing raising and lowering movement of the movable section between said intermediate end portion and said operative position. Preferably, the mechanical means comprises a motorized drive means for providing said longitudinal movement. Preferably, the mechanical means further comprises jack means for providing said raising and lowering movement. The jack means preferably includes a plurality of electrically controlled jack devices positioned at spaced locations in the recessed area. Advantageously, the jack devices each include a movable piston including a coupling member located on the distal end thereof, and the movable section includes a plurality of reciprocally shaped coupling elements, located on an underside portion thereof, for releasably coupling with respective coupling members of the pistons of the jack devices.

The motorized drive means preferably comprises a drive gear and a motor for driving said drive gear, and the movable section preferably includes at least one gear rail including a longitudinally disposed set of gear teeth engaged with, and driven by, the drive gear. The movable section preferably includes roller means thereon for providing rolling movement of the movable section on a support surface during the movement thereof to said stowed position.

In an alternative preferred embodiment, the motorized drive means comprises first and second transversely spaced, motor-driven drive gears, and the movable section includes first and second longitudinally disposed, transversely spaced gear rails, including first and second sets of gear teeth, respectively, said first and second sets of gear teeth being respectively engaged with, and driven by, the first and second drive gears.

Preferably, the system comprises electrical control means for controlling operation of the motorized drive means and for controlling the operation of said jack means, said electrical control means including a user actuated control switch assembly for, in a first switching state, activating a first sequence in which said movable section is moved from the stowed position thereof to the operative or raised position thereof and for, in a second switching state, activating a second sequence in which said movable section is moved from the operative position thereof to the stowed position thereof.

The electrical control means preferably includes limit switches, activated during movement of the movable section, for automatically terminating the operation of said motorized drive means and for automatically terminating operation of said jack means.

In an important implementation, the electrical control means includes a first set of limit switches for, when said switch assembly is in said second switching state, sensing the lowering of the movable section to said intermediate position, and for automatically activating the motorized drive means to provide a retraction movement of the movable section to the stowed position, and for, when said switch assembly is in said first switching state, sensing movement of the movable member to said intermediate position from said stowed position, and for automatically activating the jack means to provide raising of the movable section from said intermediate position to said operative position.

Advantageously, the electrical control means further comprises a user controlled emergency switch for, when actuated, automatically terminating the movement of the movable member.

In one important embodiment, a hot tub is located in the recessed area.

According to a further aspect of the invention, there is provided a system for automatically providing covering and uncovering of a hot tub, said system comprising:

a hot tub located in a first recessed area;

a further recessed area disposed adjacent to the first recessed area and defining a support surface;

a cover assembly comprising a stationary section covering said further recessed area, and a movable section movable with respect to the stationary section; and means for providing longitudinal movement of the movable section from a retracted, stowed position wherein the hot tub is uncovered, and an intermediate end position, and for providing a raising movement of the movable section from said intermediate end position and to an operative position wherein the hot tub is covered, and for providing a lowering movement of said movable section from said operative position to said intermediate end position and for providing longitudinal movement of said movable section from said intermediate end position to said stowed position, said stationary section being disposed so as to cover the further recessed area and the movable section being supported on the support surface of the further recessed area, beneath said stationary section, in the stowed position of the movable section.

Preferably, the moving means comprises a motorized drive means for providing said longitudinal movement, and jack means for providing said raising movement and said lowering movement.

Preferably, the jack means includes a plurality of electrically controlled jack devices positioned at spaced locations in the recessed area, and wherein said motorized drive means comprises a drive gear and a motor for driving said drive gear, and said movable section includes at least one gear rail including a longitudinally disposed set of gear teeth engaged with, and driven by, the drive gear.

Further features and advantages of the present invention will be set forth in, or apparent from, the detailed description of preferred embodiments thereof which follows.

DESCRIPTION OF THE PREFERRED EMBODIMENTS

Figure 1:
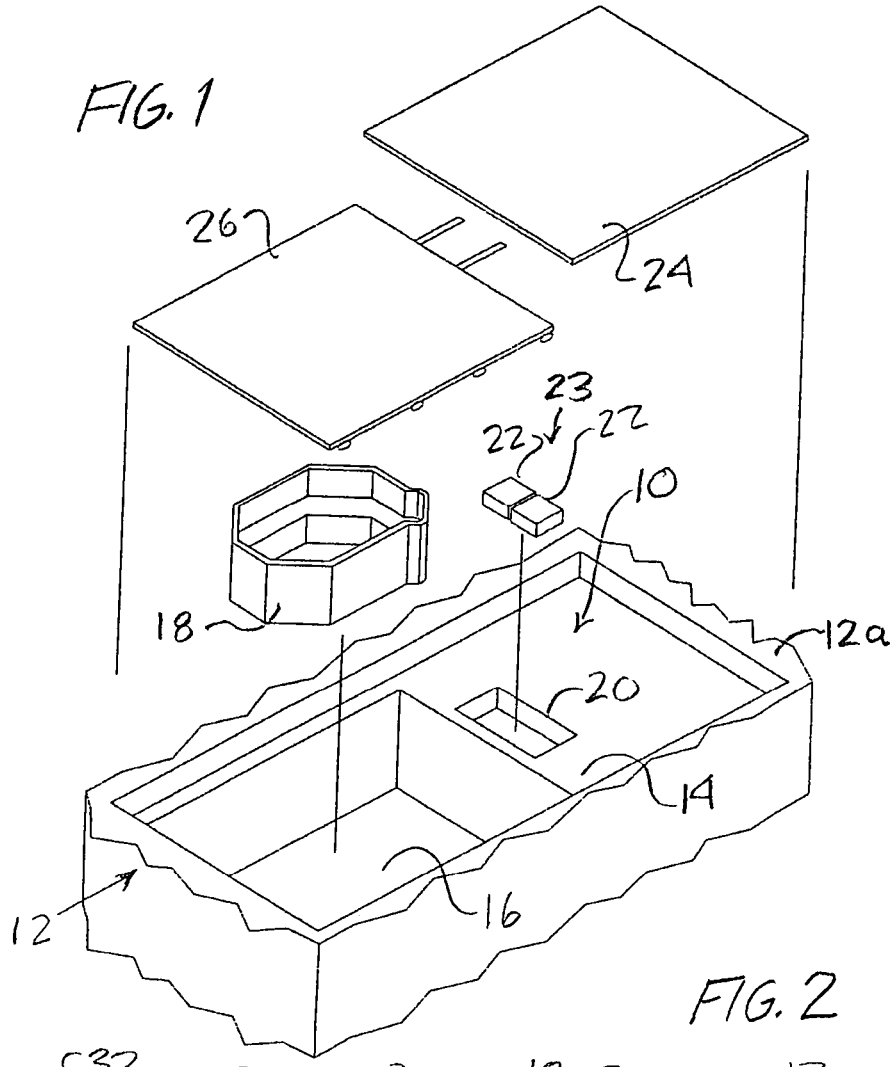
FIG. 1 is an exploded perspective view of some of the basic components of a retractable cover arrangement constructed in accordance with a preferred embodiment of the invention.

Referring to FIG. 1, some of the basic components of a preferred embodiment of the invention are shown. The basic environment illustrated in FIG. 1 is a hot tub environment, and a pit 10, provided in a base or floor 12 made of concrete or the like, includes a second relatively shallow recessed portion or recess 14 which is recessed from the upper surface 12*a* of base or floor 12 and a first relatively deep recessed portion or recess 16 provided at one end of recess 14 and serving as a tub location in which a hot tub 18 is received. It will be appreciated that hot tub 18 is conventional and can be of any suitable shape or construction.

Figure 2:
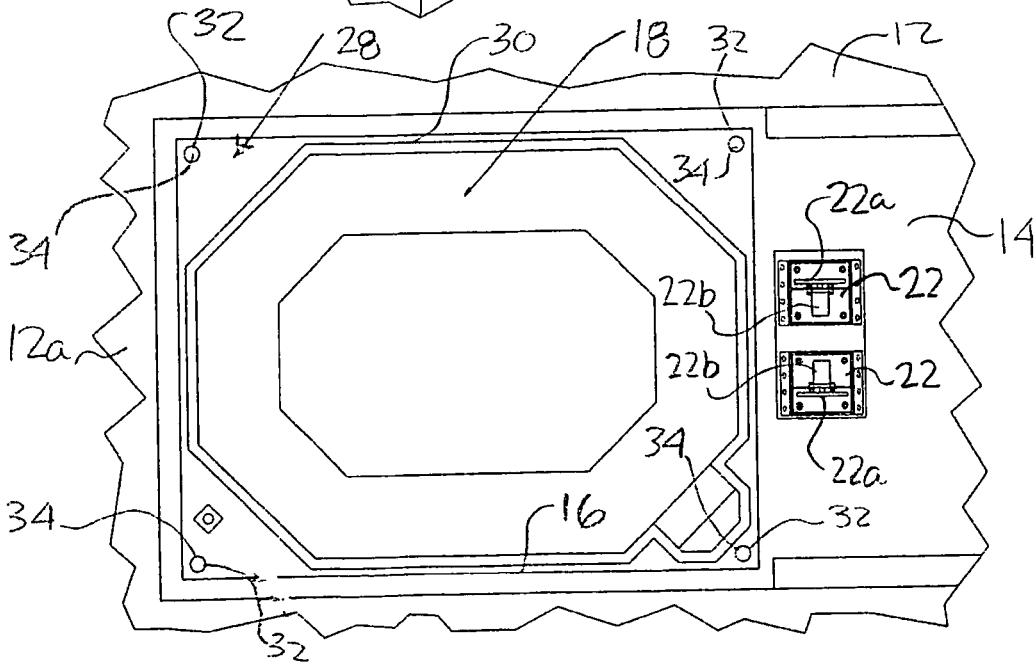
FIG. 2 is a plan view of the cover arrangement of FIG. 1, with some parts omitted and some parts broken away.

A relatively small recess or opening 20 is included in the upwardly facing bottom surface of recess 14 adjacent to tub location recess 16 and is used to house a controller or control unit 23 including a pair of motor-gear drive units 22 shown in more detail in, e.g., FIG. 2.

A fixed or stationary floor (cover) member or section 24 is disposed at the end of recess 14 opposite to the tub location. A movable floor (cover) member or section 26 is driven by motor-gear drive units 22 and movable relative to stationary floor section or member 24 between an operative or closed position and a stowed or retracted position, as described in more detail below.

Referring to FIG. 2, a partially broken plan view is provided wherein the floor sections 24 and 26 are removed. In FIG. 2, tub 18 is shown in place in recess 16 and drive units 22 are shown in more detail. Tub 18 is framed within recess 16 by a shaped framing member 28 which includes a central opening 30 in which tub 18 is received, and four openings 32 at the four corners thereof through which extend jack cones 34 of jack devices that are described in more detail below. The tub 18 is a close fit in opening 30 and tiling (not shown) is used so that there are no openings around the tub 18.

As illustrated, motor-gear drive units 22 each include a drive gear 22*a* and a motor-gearbox 22*b*. As mentioned above and described in more detail below, units 22 are used to provide sliding longitudinal movement of movable floor section 26.

Figure 3:
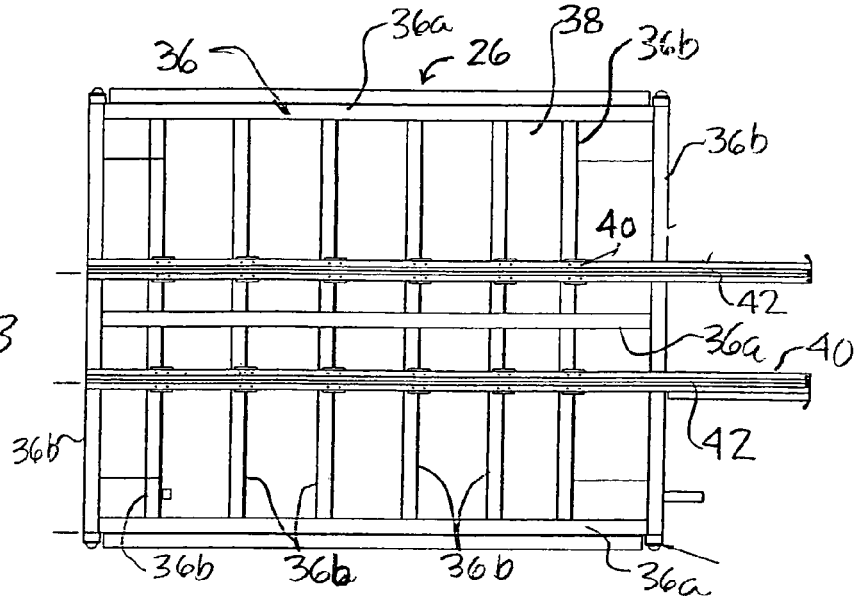
FIG. 3 is a bottom plan view of the movable floor or cover section of the embodiment of FIG. 1.

Referring to FIG. 3, there is shown the underside of movable floor section 26. In the preferred embodiment under consideration, floor section 26 comprises a frame 36 made of steel or another material of like strength, and including longitudinally extending frame members 36*a* and transverse frame members 36*b*, and a covering sheet 38, made of a hard plastic or the like, which is adhered to frame 36 by an adhesive or by other suitable means such as mechanical connectors or fasteners. Stationary floor section 24 is preferably of a similar steel frame construction and is preferably of a similar outward appearance. In a preferred embodiment, a plywood layer (not shown) and a final finished flooring layer (not shown) are provided on both the movable floor section 26 and the stationary floor section 24, so that with the sections 24 and 26 disposed in end-to-end relation, a usable floor is provided.

A pair of longitudinally extending spaced parallel gear rail rails 40 are secured to the underside of floor section 26 and, as shown, extend outwardly beyond the proximal end thereof. Two rows of gear teeth 42 respectively provided on the two gear rails 40 drivingly engage the respective drive gears 22*a* of units 22 so that rotation of gears 22*a* cause a longitudinal sliding movement of flooring section 26 in a direction determined by the direction of the angular rotation of gears 22*a*. Thus, by controlling energization (on/off switching) of electrically controller drive motors 22*a*, which provide rotation of drive gears 22*a*, as well as controlling the direction of rotation of motors 22*a*, movable floor section 26 can be remotely controlled to cause extension and retraction thereof.

Figure 4:
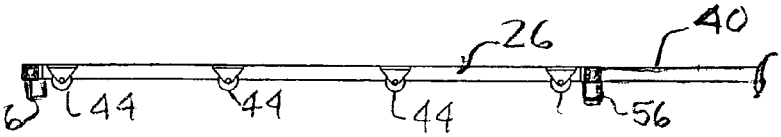
FIG. 4 is a side elevational view of the floor section of FIG. 3.

As best seen in FIG. 4 (and is not shown in FIG. 3), movable floor section 26 also includes a plurality of caster wheels or rollers 44 mounted in spaced relation along the length thereof. Wheels 44 roll on the upwardly facing surface of the shallow recess 14 as floor section 26 is moved between the operative or extended position thereof and the stowed or retracted position thereof.

Figure 5:
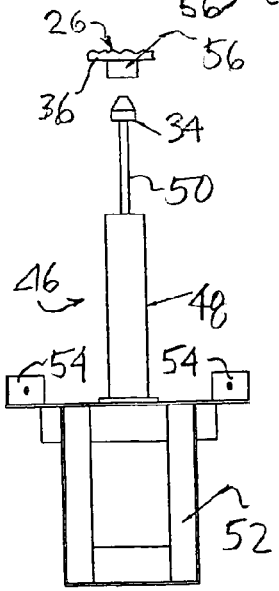
FIG. 5 is a side elevational view of one of the jack devices employed in the preferred embodiment of the invention.

Referring to FIG. 5, there is shown one of the abovementioned jacks or jack devices, which is denoted 46 in FIG. 5. Jack 46 includes a piston 48 including a piston rod 50 having a cone 34 (corresponding to those mentioned above) mounted on the distal end thereof. Jack 46 includes a jack mount 52 which is adapted to be disposed in one of the four corners of recess 16 and secured in place therein. To this end, flanges 54 on the jack mount 52 are adapted to be bolted to the two adjacent walls forming the corner, although other methods for securing the jacks 46 in place can also be used.

As indicated in FIG. 5, each cone 34 is adapted to be received in a reciprocally shaped receptacle 56 (two of which are also shown in FIG. 4) secured to the underside of movable floor section 26, with four such receptacles being secured to floor section 26 at the respective corners thereof. In another embodiment, one of the receptacles 56 is positioned at an intermediate position because of the tub entrance at one corner, and the corresponding jack is positioned accordingly. In one preferred embodiment, each cone 34 is threaded and an adjustable locking mechanism (not shown) including, e.g., an adjustable lock nut (not shown) is used to lock the movable section 26 in place.

Figure 6:
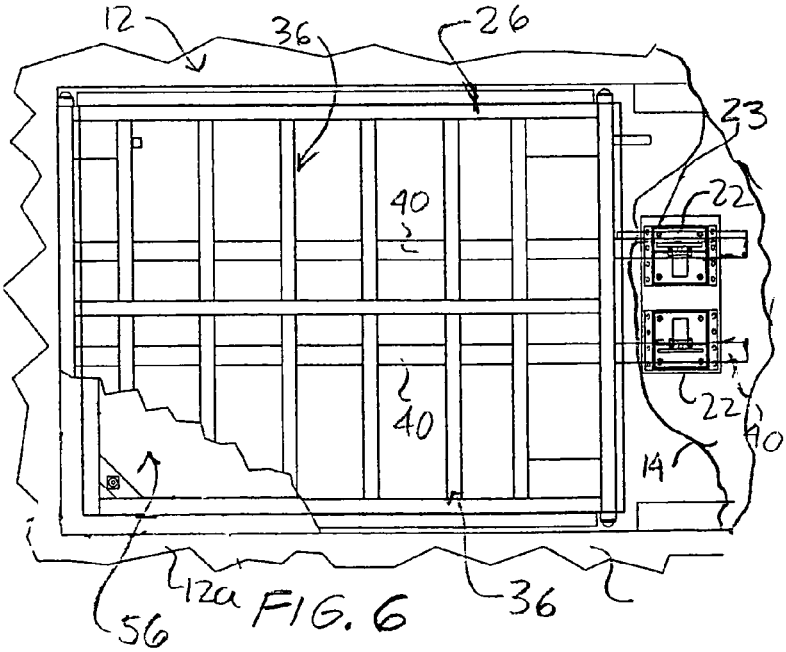
FIG. 6 is a top plan view, with some parts omitted, some parts shown in dashed lines, and some parts broken away, of the cover arrangement of FIG. 1, showing the movable floor section in the operative position thereof.
Figure 7A:
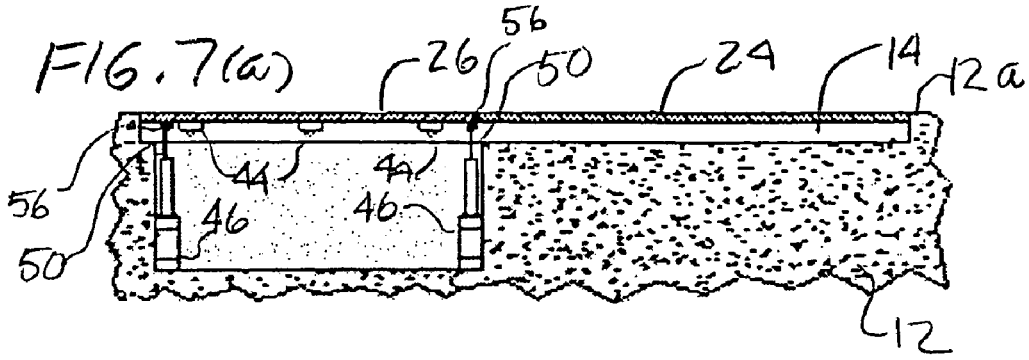
FIGS. 7(*a*) to 7(*d*) are cross-sectional views of the cover arrangement of FIG. 1, showing the different stages in the operation thereof.
Figure 7B:
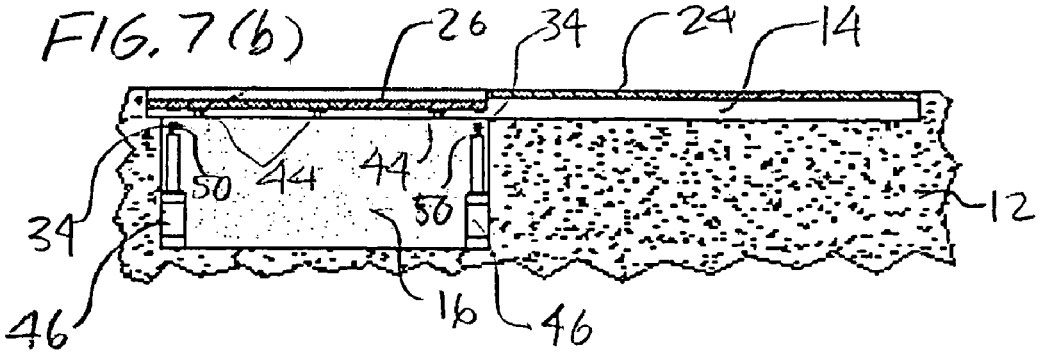
Figure 7C:
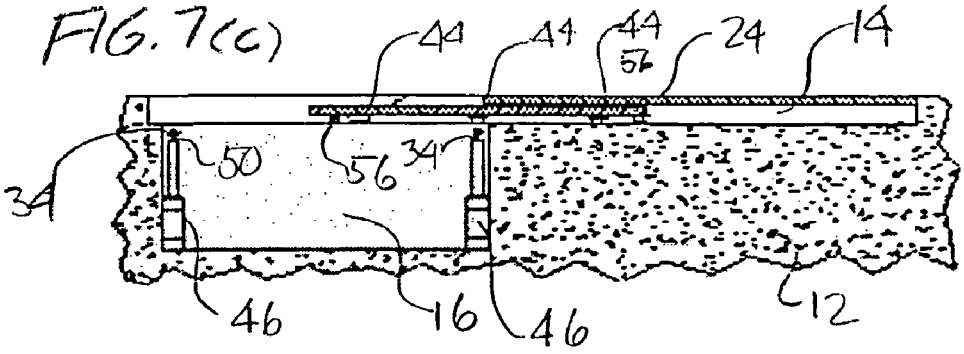
Figure 7D:
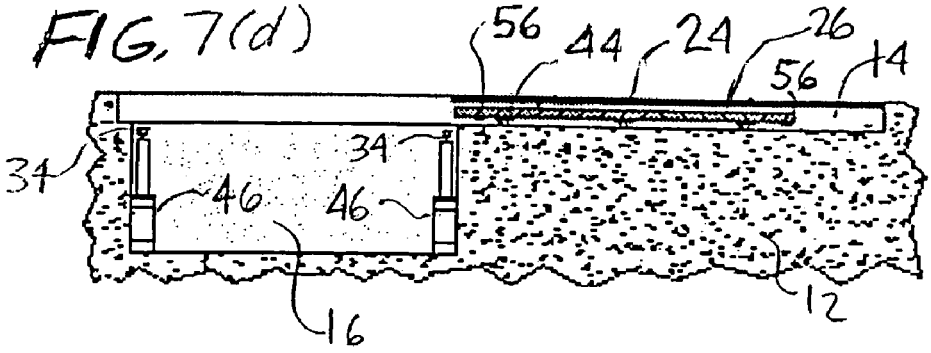

Referring to FIG. 6, there is shown a plan view of floor section 26 in the operative position in place over recess 16, and thus in place over hot tub 18 (not shown in FIG. 6). The floor covering 38 is omitted in FIG. 6, and one corner of floor section 26 is broken away to show a corner mounting area 58 in which one of the jacks, corresponding to jack 46 of FIG. 5, would be mounted, it being understood that FIG. 5 and FIG. 6 are drawn to different scales.

The overall construction and operation of this embodiment of the invention can perhaps be best understood by referring to FIGS. 7(*a*) to 7(*d*). In FIG. 7(*a*), floor section or cover 26 is shown in place in its operative position flush with fixed floor section 24 and, in this preferred embodiment, with the upper floor surface 12*a*. Thus, as discussed above, floor sections 24 and 26 together form a usable floor that can be walked on and used, e.g., for dancing. In this position, floor section 26 acts as a cover for hot tub 18 and, in cooperation with fixed floor 24, provides a continuous cover or floor for pit 10. Floor sections 24 and 26 are disposed in end-to-end registration in this position of floor section 24, and this end-to-end registration, the complementary outward appearances of the two floor sections, and the flush fit between the two sections results in the cover assembly having an aesthetically pleasing overall appearance. Floor section 26 is supported by the abovementioned jacks 46 (two of which are shown in FIG. 7(*a*)), with the piston rods 50 thereof extended and with the cones 34 affixed to the distal ends of pistons 50 received in receptacles 56 on the underside of floor section 26.

When it is desired to use the hot tub 18, and thus to retract the floor section 26 to expose the hot tub area defined by framing member 28 and hot tub 18, in a first step, which is shown in FIG. 7(*b*), floor section 26 is dropped or lowered to a retracted position below fixed floor section 24 by lowering pistons 50 of jacks 46. When floor section 26 reaches this position, pistons 50 of jacks 46 are withdrawn so that cones 34 separate from receptacles 56 of floor section 26. In one preferred embodiment, the cones 34 are fully withdrawn so as to be completely out of sight.

Next, as shown in FIG. 7(*c*), the motor-gear drive units 22 (which are not shown in FIGS. 7(*a*) to 7(*c*)) are actuated and floor section 26 is retracted. As indicated above, this is accomplished by what is essentially a rack and pinion connection between the gear teeth 42 of gear rails 40 and the drive gears 22*a* of motor-gear drive units 22.

Floor section 26 is shown in FIG. 7(*c*) in an intermediate, half-open/half-closed position during its travel to the completely retracted, stowed position which is illustrated in FIG. 7(*d*). As shown in FIGS. 7(*c*) and 7(*d*), caster wheels or rollers 44 of gear rails 40 ride on the upwardly facing bottom surface of recess 14 to the stowed position shown in FIG. 7(*d*) wherein sections 24 and 26 are disposed in different planes in vertical registration.

It will, of course, be understood that movable floor section 24 can also be moved from the stowed position shown in FIG. 7(*d*) to the operative position shown in FIG. 7(*a*) by, in essence, reversing the steps described beginning with moving floor section 24, to the left as viewed in FIGS. 7(*a*) to 7(*d*), to the intermediate end position shown in FIG. 7(*b*). It is noted that an insulated pad (not shown), typically about 3 inches thick, may be fitted over hot tub 18 to combat evaporation of the water in the tub.

Figure 8:
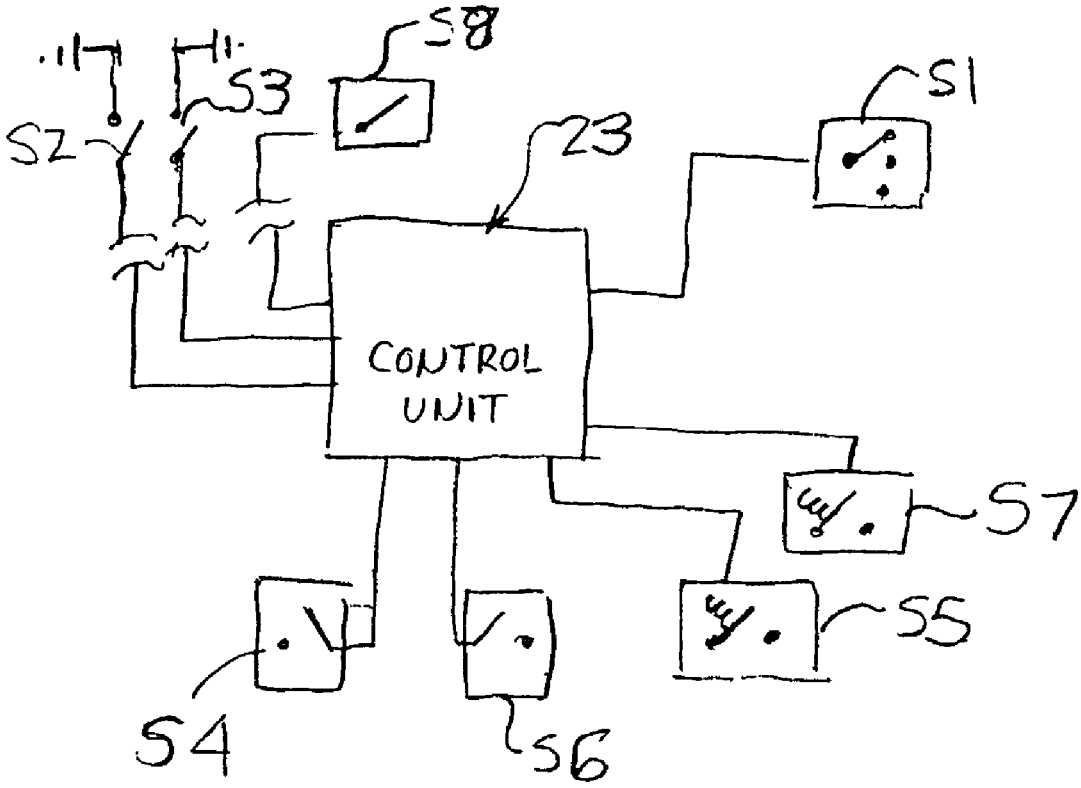
FIG. 8 is a schematic diagram of a preferred embodiment of a control system for the cover arrangement of FIG. 1.

Referring to FIG. 8, there is shown a schematic diagram of basic components of the motor and jack control system or controller for the movable floor section 26. The control system includes the control unit 23 described above and located in opening 20 in recessed portion 14 of pit 10.

A three-position switch S1, advantageously located on a wall (not shown) in the tub area, controls raising and lowering of floor section 26. In addition to an off position, switch S1 includes a first switch position wherein switch S1 activates the sequence described above wherein the floor section 26 is dropped by jacks 46 to the lowered position shown in FIG. 7(*b*), and a second switch position wherein switch S1 activates the reverse sequence wherein the floor section 26 is raised by jacks 46 to the operative, flush position shown in FIG. 7(*a*).

After switch S1 is actuated to the first switch position thereof, a limit switch S2, which is disposed so as to be actuated by movement of the floor section 26 to the lowered intermediate end position thereof shown in FIG. 7(*b*), stops or terminates the lowering movement of the floor section 26.

A further limit switch S3 is also actuated at this time which causes the motor-gear drive units 22 to begin retracting of floor section 26. An additional limit switch S4 controls units 22 so that the retracting forces on floor section 26 are terminated when the floor section 26 approaches the stowed end position thereof.

A normally closed plunger-type switch S5, located on the floor of recess 14 and actuated by movement of the floor section 26 to the stowed end position thereof wherein floor section 26 is disposed in vertical registration beneath floor section 24 as shown in FIG. 7(*d*), terminates the retraction movement of the floor section 26. At this point, retraction of floor section 26 is completed, and floor section 26 is stowed as shown in FIG. 7(*d*).

Actuation of switch S1 to the second switch position causes the longitudinal sliding movement of floor section 26 to the intermediate end position thereof illustrated in FIG. 7(*b*), i.e., to the left as viewed in FIGS. 7(*a*) to 7(*d*). Limit switch S4, which was mentioned above, controls units 22 so that the pushing forces on floor section 26 are terminated when floor section 26 reaches the position shown in FIG. 7(*b*). This results in actuation of a further limit switch S6, which is positioned in the path of floor section 26 so as to be actuated thereby when floor section 26 reaches the position shown in FIG. 7(*b*). Actuation of limit switch S6 causes actuation of the jacks 46 to provide extension of the jack pistons 50 so as to thereby raise the floor section 26 as described above so that floor section 26 is moved to the operative or closed position shown in FIG. 7(*a*).

A normally closed, plunger-type limit switch, S7, actuated by movement of the floor section 26 to the end position thereof, ensures that the extension movement of jack pistons 50 is stopped when the floor section 26 is back in the operative or closed position thereof, flush with stationary floor section 24.

A normally open "panic" switch or emergency switch S8, operable by the user and advantageously located at a convenient position in the tub area, enables the floor retraction operation, and the floor closing operation, to be immediately terminated in the event that there is an obstruction or another problem that makes closing or retracting of the floor section 26 dangerous or otherwise undesirable.

It will be appreciated that while the invention has been described above in connection with providing covering and uncovering of a hot tub, the same basic system or approach can be used in connection with covering a swimming pool or the like.

Although the invention has been described above in relation to preferred embodiments thereof, it will be understood by those skilled in the art that variations and modifications can be effected in these preferred embodiments without departing from the scope and spirit of the invention.

What is claimed:

1. A system for automatically providing covering and uncovering of a first recessed area, said system comprising:

a hot tub or spa received in said first recessed area, a cover assembly comprising a movable cover section movable with respect to a stationary cover member disposed adjacent to the first recessed area and defining a plane; and means for moving the movable cover section between (i) a retracted, stowed position, out of the plane of the stationary cover member and in vertical registration with and beneath the stationary cover member, wherein the first recessed area is uncovered, and (ii) an operative, extended position, in the plane of and flush with the stationary cover member and in end-to-end registration with the stationary cover member, wherein the first recessed area is covered, a second recessed area disposed adjacent to the first recessed area and defining a support surface, wherein said cover assembly disposed on top of said support surface and substantially above the water line of the hot tub or spa, said stationary cover member of said cover assembly being disposed so as to cover the second recessed area, and the movable cover section being supported on the support surface of the second recessed area, beneath said stationary cover member, in the retracted, stowed position of the movable cover section, said means for moving comprising a mechanical drive assembly providing slidingly longitudinal movement of the movable cover section between said retracted, stowed position and an intermediate end position out of vertical registration with the stationary cover member and on top of said first recessed area, said mechanical drive assembly further providing raising and lowering movement of the movable cover section between said intermediate end position and said operative, extended position, said mechanical drive assembly comprising a motorized drive means for providing said slidingly longitudinal movement, and jack means for providing said raising and lowering movement, said jack means includes a plurality of electrically controlled jack devices positioned at spaced locations in the first recessed area, said jack devices each including a movable piston including a coupling member of a non-flat shape located on the distal end thereof, and said movable cover section includes a plurality of reciprocally shaped coupling elements, located on an underside portion thereof, for releasably coupling with respective coupling members of the pistons of the jack devices.

2. A system according to claim 1 wherein said motorized drive means comprises at least drive gear and at least one motor for driving said drive gear, and said movable cover section includes at least one gear rail including a longitudinally disposed set of gear teeth engaged with, and driven by, the at least one drive gear.

3. A system according to claim 2 wherein said movable cover section includes roller means thereon for providing rolling movement of the movable cover section on the support surface during the movement thereof to said stowed position.

4. A system according to claim 1 wherein said motorized drive means comprises first and second transversely spaced, motor-driven drive gears, and the movable cover section includes first and second longitudinally disposed, transversely spaced gear rails, including first and second sets of gear teeth, respectively, said first and second sets of gear teeth being respectively engaged with, and driven by, the first and second drive gears.

5. A system according to claim 1 wherein one of said coupling members and said coupling elements includes a cone-shaped head portion.

6. A system according to claim 1 wherein each said cone-shaped head portion is threaded.

7. A system for automatically providing covering and uncovering of a first recessed area, said system comprising:

a hot tub or spa received in said first recessed area, a cover assembly comprising a movable cover section movable with respect to a stationary cover member disposed adjacent to the first recessed area and defining a plane; and means for moving the movable cover section between (i) a retracted, stowed position, out of the plane of the stationary cover member and in vertical registration with and beneath the stationary cover member, wherein the first recessed area is uncovered, and (ii) an operative, extended position, in the plane of and flush with the stationary cover member and in end-to-end registration with the stationary cover member, wherein the first recessed area is covered, a second recessed area disposed adjacent to the first recessed area and defining a support surface, wherein said cover assembly disposed on top of said support surface and substantially above the water line of the hot tub or spa, the stationary cover member of said cover assembly being disposed so as to cover the second recesses area, said movable cover section being supported on the support surface of the second recessed area, beneath said stationary section, in the retracted, stowed position of said movable cover section, said means for moving comprising a mechanical drive assembly providing slidingly longitudinal movement of the movable cover section between said retracted, stowed position and an intermediate end position out of vertical registration with the stationary cover member and on top of said first recessed area, said mechanical drive assembly further providing raising and lowering movement of the movable cover section between said intermediate end position and said operative, extended position, said mechanical drive assembly comprising a motorized drive means for providing said slidingly longitudinal movement, and jack means for providing said raising and lowering movement, and said system further comprising electrical control means for controlling operation of the motorized drive means and for controlling the operation of said jack means, said electrical control means including a user actuated control switch assembly for, in a first switching state, activating a first sequence in which said movable cover section is moved from the retracted, stowed position thereof to the operative, extended position thereof and for, in a second switching state, activating a second sequence in which said movable cover section is moved from the operative, extended position thereof to the retracted, stowed position thereof, said electrical control means further including limit switches, activated during movement of the movable cover section, for automatically terminating the operation of said motorized drive means and for automatically terminating operation of said jack means, said limit switches including a first set of limit switches for, when said switch assembly is in said second switching state, sensing the lowering of the movable cover section to said intermediate end position, and for automatically activating the motorized drive means to provide a retraction movement of the movable cover section to the retracted, stowed position, and for, when said switch assembly is in said first switching state, sensing movement of the movable cover section to said intermediate end position from said retracted, stowed position, and for automatically activating the jack means to provide raising of the movable cover section from said intermediate end position to said operative, extended position, and said electrical control means further comprising a user controlled emergency switch for, when actuated, automatically terminating the movement of the movable cover section.

* * * * *